US007287676B2

(12) United States Patent
Chua

(10) Patent No.: US 7,287,676 B2
(45) Date of Patent: Oct. 30, 2007

(54) BABY BLANKET FOR USE WITH FRONT-WORN BABY CARRIER

(76) Inventor: Cathleen Siok-Syuan Chua, 5800 Ross St., Oakland, CA (US) 94618

( * ) Notice: Subject to any disclaimer, the term of this patent is extended or adjusted under 35 U.S.C. 154(b) by 383 days.

(21) Appl. No.: 10/814,888

(22) Filed: Mar. 30, 2004

(65) Prior Publication Data

US 2005/0218168 A1 Oct. 6, 2005

(51) Int. Cl.

| | |
|---|---|
| ***A41B 13/06*** | (2006.01) |
| ***A47C 31/10*** | (2006.01) |
| ***A47C 31/00*** | (2006.01) |
| ***A47G 9/02*** | (2006.01) |
| ***A61G 1/00*** | (2006.01) |

(52) U.S. Cl. ..... 224/160; 2/69; 2/69.5; 5/482; 5/494; 297/467; 224/159

(58) Field of Classification Search ..... 224/160
See application file for complete search history.

(56) References Cited

U.S. PATENT DOCUMENTS

| | | | | |
|---|---|---|---|---|
| 3,996,620 | A * | 12/1976 | Maine | 2/457 |
| 4,597,121 | A | 7/1986 | Bouma | 5/494 |
| 5,129,406 | A * | 7/1992 | Magnusen et al. | 128/873 |
| 5,457,826 | A * | 10/1995 | Haraga et al. | 4/541.4 |
| 5,490,620 | A | 2/1996 | Bergqvist | 224/160 |
| 5,722,094 | A * | 3/1998 | Ruefer | 2/69.5 |
| 5,735,004 | A * | 4/1998 | Wooten et al. | 5/502 |
| 5,740,566 | A * | 4/1998 | Stacy | 5/420 |
| 5,950,261 | A * | 9/1999 | Hay et al. | 5/482 |

(Continued)

FOREIGN PATENT DOCUMENTS

GB 2084861 A * 4/1982

(Continued)

OTHER PUBLICATIONS

Internet pages entitled "Mugwumps—Special Stuff For Kids and 'Dults", www.mugwumps.biz, 2 pages, downloaded Oct. 21, 2003.

(Continued)

*Primary Examiner*—Nathan J. Newhouse
*Assistant Examiner*—Lester L. Vanterpool
(74) *Attorney, Agent, or Firm*—Imperium Patent Works; T. Lester Wallace

(57) ABSTRACT

An adjustable baby blanket snuggly covers a baby in a front-worn baby carrier. The baby blanket includes a pouch, a back, a left arm extension, a right arm extension, and a hood. In use, the pouch is slipped up around the baby's legs such that the bottom portion of the baby extends into the pouch. The left arm extension is wrapped around the baby carrier such that the left arm extension passes to the right between the left and right shoulder straps of the baby carrier and the wearer. The right arm extension is wrapped around the baby carrier such that the right arm extension passes to the left between the two shoulder straps of the baby carrier and the wearer. The ends of the left and right arm extensions are then tied together at a location on the opposite side of the baby carrier with respect to the wearer.

7 Claims, 8 Drawing Sheets

Front View

U.S. PATENT DOCUMENTS

| | | | | |
|---|---|---|---|---|
| 6,817,033 | B2 * | 11/2004 | Bailey | 2/69.5 |
| 2002/0078494 | A1 | 6/2002 | Hunter | 2/463 |
| 2003/0178452 | A1 * | 9/2003 | Norman | 224/160 |
| 2003/0191514 | A1 * | 10/2003 | Chatham | 607/107 |
| 2004/0019969 | A1 * | 2/2004 | Gatten | 5/482 |

FOREIGN PATENT DOCUMENTS

| | | | |
|---|---|---|---|
| JP | 09-094136 | * | 8/1997 |
| JP | 2004-003084 | * | 8/2004 |

OTHER PUBLICATIONS

Internet pages entitled "Baby Carrier Original" and "Baby Carrier Active", www.babybjorn.com, 3 pages, downloaded Mar. 11, 2004.

Internet pages entitled "BabyPacks.com Kids Ride Free!", www.babypacks.com, 2 pages, downloaded Mar. 1, 2004.

* cited by examiner

Front View

Back View

BABY BLANKET FOR USE WITH FRONT-WORN BABY CARRIER

TECHNICAL FIELD

The present invention relates to baby blankets, and more particularly to baby blankets adapted for covering babies being carried in front-worn baby carriers.

BACKGROUND INFORMATION

One popular way of carrying a baby is to carry the baby on the chest using a front-worn baby carrier. FIG. 1 (Prior Art) is a perspective view of a popular front-worn baby carrier 1 called the BABYBJORN Baby Carrier. See, for example, U.S. Pat. No. 5,490,620, to Bergqvist, assigned to Baby Bjorn AB, of Stocksund, Sweden. Baby carrier 1 includes two padded straps 2 and 3 and a child carrying pouch 4. The two straps cross over each other in the middle of the back of the wearer. Strap 2 extends over the right shoulder 5 and crosses over to the left side of the body behind the back of the wearer, and then extends around the left side of the midriff of the wearer, and then attaches to the child carrying pouch 4 in the vicinity of the stomach of the wearer. Similarly, strap 3 extends over the left shoulder 6 and crosses over to the right side of the body behind the back of the wearer, and then extends around the right side of the midriff of the wearer, and then attaches to the child carrying pouch 4 in the vicinity of the stomach of the wearer. Baby carrier 1 has arm openings through which the arms of the baby extend, as well as leg openings through which the legs of the baby extend.

FIG. 2 (Prior Art) is a perspective view of a baby 7 being carried in front-worn baby carrier 1. Baby 7 is shown in the inward-facing position. The baby's head is being supported by the neck rest portion of pouch 4. The baby's legs are hanging down through the leg openings, and the baby's bottom is being supported by the base of pouch 4. Although not illustrated here, baby 7 can also be carried in an outward-facing position such that the back of the baby's head rests on the wearer's chest. The neck-rest upper portion of pouch 4 can be folded down so that the baby can look out to the front. Although the Baby Bjorn type of baby carrier is described here, there are numerous other similar types and brands of front-worn baby carriers available on the market today.

As is evident from FIG. 2, the arms and legs of a baby in a front-worn baby carrier extend out from the warmth of the pouch. In cool or cold conditions, the baby's arms and legs can get cold. Moreover, the top of the baby's head is exposed. In very cold weather, the insulation provided by the pouch 4 may not be enough even for unexposed portions of the baby's body. A small baby blanket is therefore desired that can be used to cover the baby when the baby is being carried in a front-worn baby carrier.

One such blanket designed for use with a front-worn baby carrier is called the Cozy Topper. This baby blanket is available from Mugwumps of Lodi, Calif. The blanket is basically a fleece sack having a pair of ribbon straps and a flap. The sack is kept in place around the baby's body by wrapping the ribbon straps around the shoulder straps of the baby carrier. The ribbon straps are secured in place using Velcro. The Cozy Topper is loose fitting. The Cozy Topper is advertized as providing plenty of room for the baby to move around inside the sack, whether the baby is facing inward or outward. The top rim of the opening of the sack has an elastic member so that the opening constricts around the baby. The flap, which extends from the front rim of the sack, can be tucked around the baby's head or shoulders. To keep the baby's head warm, a separate matching fleece hat is provided.

A more elegant and more adjustable alternative baby blanket for use with a front-worn baby carrier is desired.

SUMMARY

An adjustable baby blanket snuggly covers a baby in a front-worn baby carrier. The baby blanket includes a pouch portion, a back portion that extends upward from the pouch portion and terminates in a hood portion, a left arm extension portion that extends to the left from the left side of the back portion and pouch portion, and a right arm extension that extends to the right from the right side of the back portion and pouch portion. The pouch portion has an opening.

A first mechanism is provided so that the opening of the pouch portion can be constricted. This first mechanism may, for example, be a drawstring that is provided in a channel or guide in the rim of the pouch portion. The drawstring, unlike an elastic band, can be adjusted such that it does not put continuous constricting pressure on the baby.

A second mechanism is provided for adjusting the depth of the pouch. This second mechanism may, for example, include a first portion and a second portion. The first portion is connected to the bottom inside of the pouch. The second portion is connected to the rim of the pouch portion. To reduce the depth of the pouch, the first portion at the bottom of the pouch can be tied up to the second portion such that the bottom of the pouch portion is suspended from the rim of the pouch portion. For a small baby having short legs, the second mechanism is used to reduce the depth of the pouch such that the baby fits snuggly in the pouch portion.

In use, the second mechanism is used to adjust the depth of the pouch to accommodate the size of the baby as set forth above. The pouch portion is then slipped up around the legs of the baby such that the bottom portion of the baby extends into the pouch through the opening. The first mechanism is then used to constrict the opening of the pouch portion around the baby and baby carrier. The left arm extension portion is wrapped around the baby carrier such that the left arm extension portion passes to the right between the left and right shoulder straps of the baby carrier and the wearer. The right arm extension portion is wrapped around the baby carrier such that the right arm extension portion passes to the left between the right and left shoulder straps of the baby carrier and the wearer. The ends of the left and right arm extension portions are then detachably coupled (for example, tied) together at a location on the opposite side of the baby carrier with respect to the wearer. The tightness with which the baby is shrouded in the baby blanket is controlled by controlling how tight the left and right arm extension portions are pulled before being tied together. The chest of the baby is not under constant constriction pressure as would be the case if elastic bands were used in place of the left and right arm extension portions, yet the blanket can be snuggly tied around the baby and baby carrier if desired. The degree of tightness is controllable by the wearer (for example., a mother or father wearing the baby carrier). The hood portion can be extended up so that it covers the head of the baby. The hood portion can also be folded down so that the head of the baby is exposed.

In one advantageous aspect, the bottom sides of the left and right arm extension portions extend from the pouch portion starting at locations below the rim of the opening in the pouch portion. The left and right arm extension portions therefore cover or help cover any portions of the baby's body (for example, the baby's arms) that might hang down below the level of the rim of the pouch portion. The left and right arm extension portions also cover or help cover any portions of the baby's body (for example, the baby's thighs) that might be exposed above the rim of the pouch portion.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
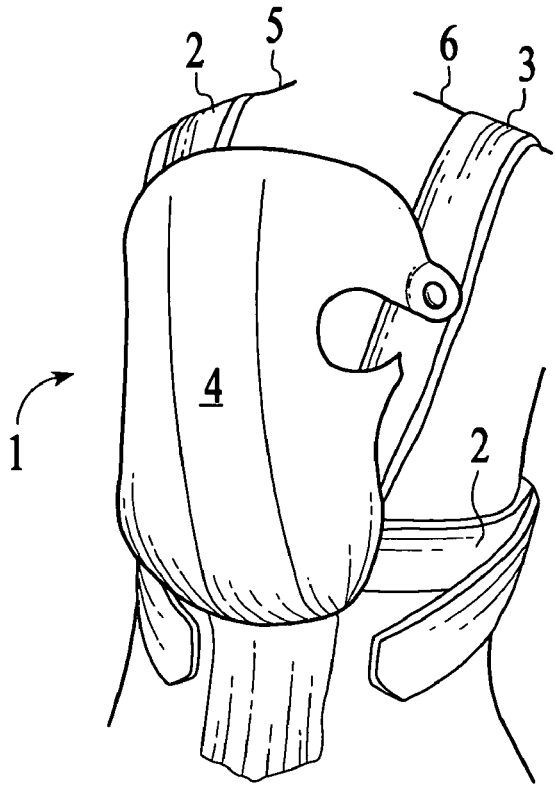
FIG.1 (PRIOR ART)
FIG. 1 (Prior Art) is a perspective view of front-worn baby carrier.
Figure 2:
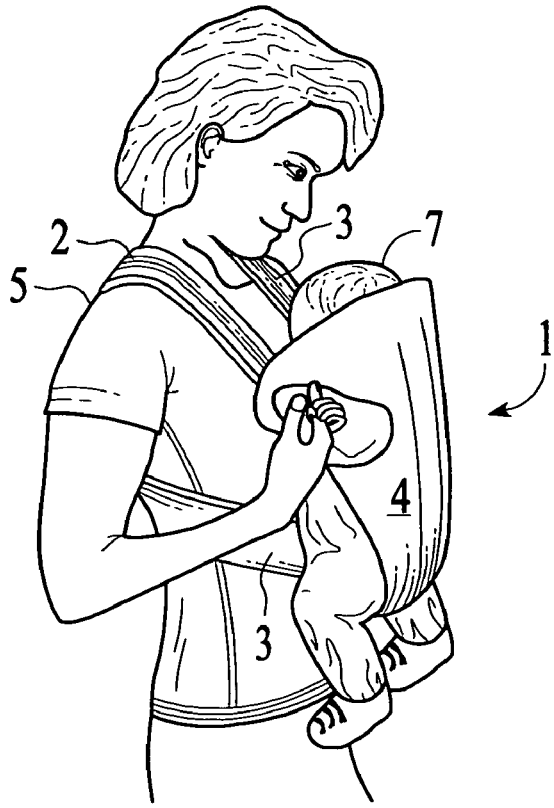
FIG.2 (PRIOR ART)
FIG. 2 (Prior Art) is a perspective view showing a baby in the front-worn baby carrier of FIG. 1.
Figure 3:
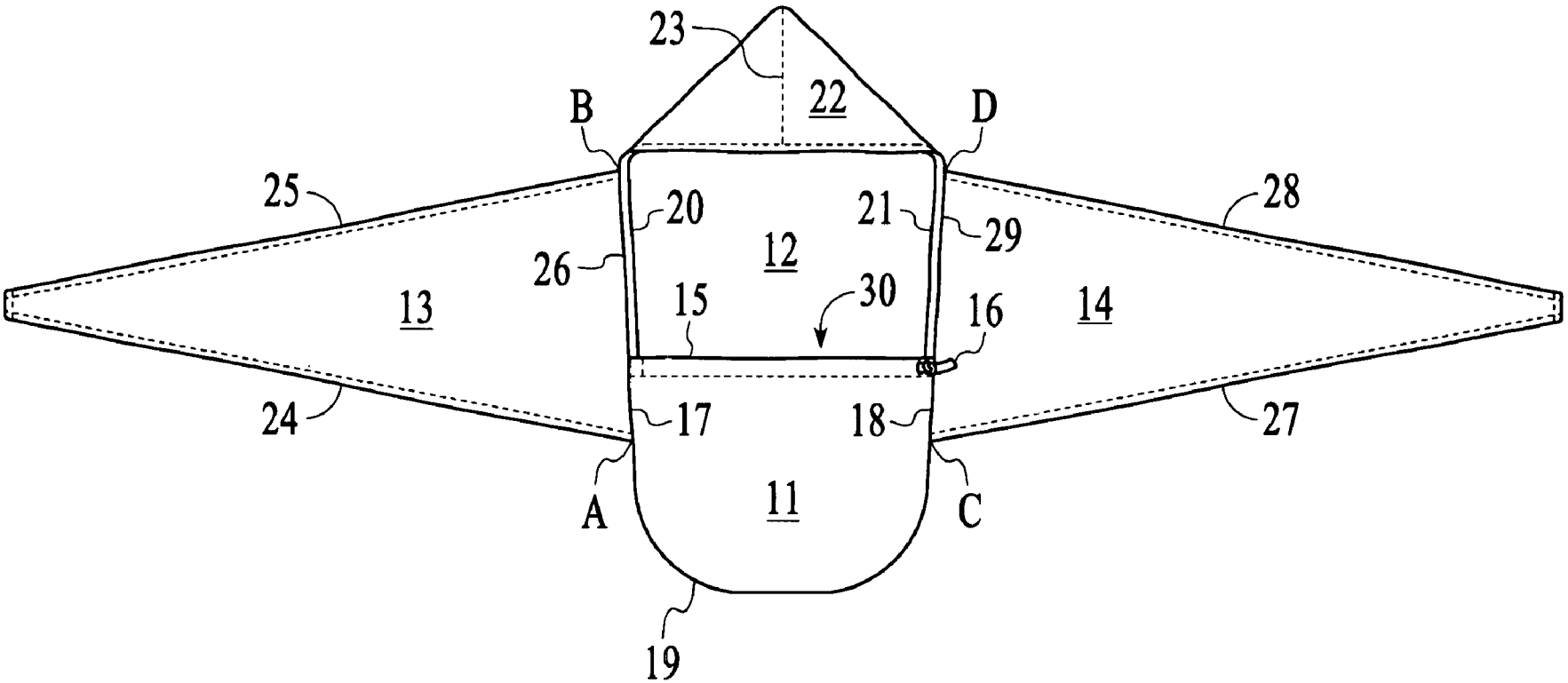
FIG. 3 is a front view of the baby blanket in accordance with one embodiment of the present invention.

FIG. 3 is a front view of a baby blanket 10 in accordance with one embodiment of the present invention. Baby blanket 10 is made of fleece fabric or similar comfortable and protective material and includes a pouch portion 11, a back portion 12, a left arm extension portion 13, and a right arm extension portion 14. Baby blanket 10 is shown in top-down perspective from the front when the baby blanket 10 is laying flat with pouch portion 11 collapsed, and with the left and right arm extension portions 13 and 14 spread out and extending to the left and right, respectively.

Pouch portion 11 has an opening 30 defined in part by a front rim 15 of the pouch portion 11. A fabric drawstring 16 is provided in a channel in front rim 15 so that opening 30 can be constricted by pulling the drawstring 16 with respect to the remainder of pouch portion 11. In this example where pouch portion 11 is seen laying flat, pouch portion 11 has a left side 17 and a right side 18. A bottom side 19 of the pouch portion extends from the left side 17 to the right side 18. The bottom side 19 has a substantially semicircular shape as is evident from FIG. 3.

Back portion 12 extends upward from pouch portion 11. Back portion 12 has a left side 20 that extends upward from the left side 17 of pouch portion 11. Back portion 12 also has a right side 21 that extends upward from right side 18 of pouch portion 11. In the illustrated example, the fabric of back portion 12 is extended upward and ends in a horizontal edge. The horizontal edge extends from an upper left corner to an upper right corner. A hood portion 22 is made by folding the upper left corner down and inward, folding the upper right corner down and inward, and then stitching the left half of the folded down upper edge to the right half of the folded down upper edge. Once stitched together, the hood portion 22 is turned inside out to hide the stitched together fabric edges so that the resulting hood portion 22 appears as illustrated in FIG. 3. Dashed line 23 represents the stitching.

In one embodiment, the pouch portion, back portion and hood portion are made from two panels of fabric. A first panel forms the back fabric layer of the pouch portion, the back portion and the hood portion. A second panel forms the front fabric layer of the pouch portion. The second panel is placed on the first panel, and the two panels are cut so that the bottom of the pouch portion has the semicircular shape illustrated in FIG. 3. The cut edges of the two panels are stitched together to form a pouch, and the pouch is turned inside out to hide the cut edges of fabric on the inside of the pouch. The hood portion 22 is made as set forth above by folding down upper corners of the first panel and stitching the left and right halves of the upper fabric edge as set forth above.

In addition to pouch portion 11, back portion 12 and hood portion 22, the baby blanket 10 includes the left arm extension portion 13 and the right arm extension portion 14. Left arm extension portion 13 has a substantially triangular shape and has three sides: a first side 24, a second side 25, and a third side 26. Third side 26 is at least eight inches long. The left arm extension portion 13 tapers and gets narrower as it extends to the left. First side 24 extends to the left from a location A on left side 17 of pouch portion 11. Location A is located at least two inches below the front rim 15 of pouch portion 11. Second side 25 extends to the left from a location B on left side 26 of back portion 12.

Similarly, right arm extension portion 14 has a substantially triangular shape and has three sides: a first side 27, a second side 28, and a third side 29. Third side 29 is at least eight inches long. The right arm extension portion 14 tapers and gets narrower as it extends to the right. First side 27 extends to the right from a location C on right side 18 of pouch portion 11. Location C is located at least two inches below the front rim 15 of pouch portion 11. Second side 28 extends to the right from a location D on right side 29 of back portion 12.

Figure 4:
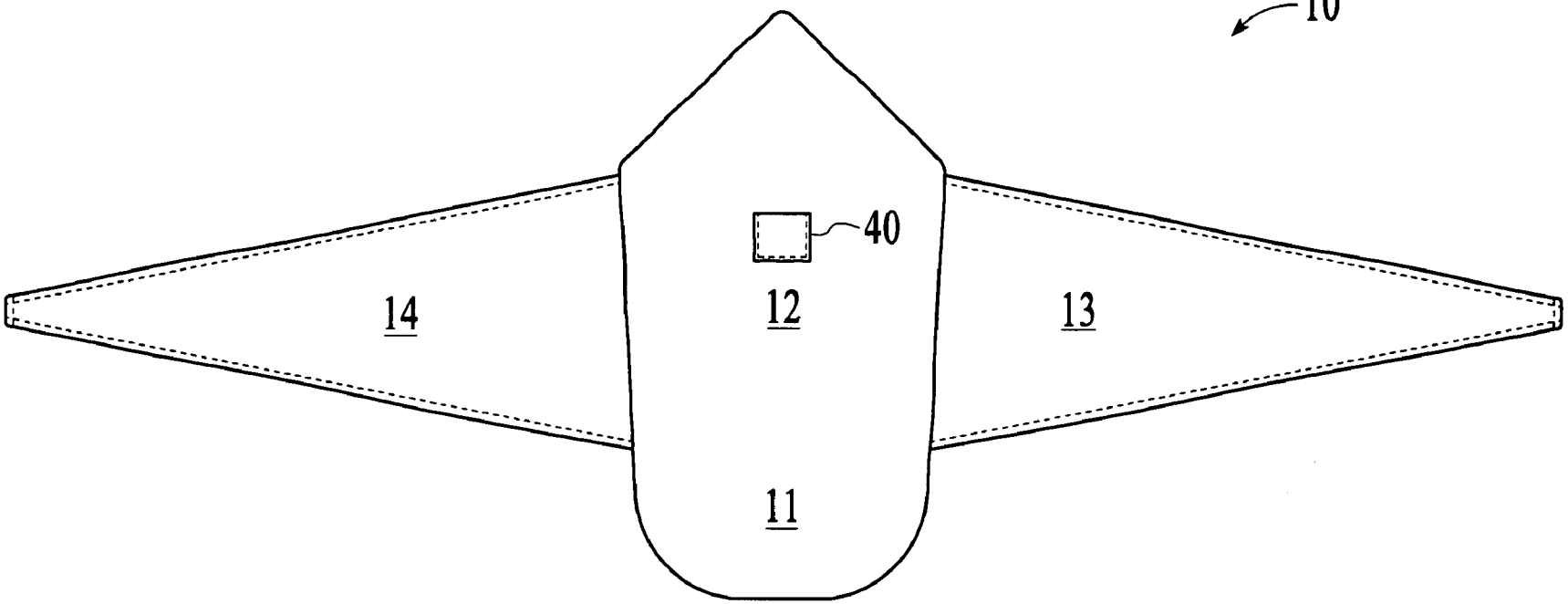
FIG. 4 is a back view of the baby blanket of FIG. 3.

FIG. 4 is a back view of baby blanket 10 of FIG. 3 when the baby blanket is laying flat. A small pocket 40 is stitched onto back portion 12. In this embodiment, the pocket is not greater than five inches across and is adapted to snuggly hold a small item such as a pacifier, a set of house keys, or a transit pass or card access pass.

The pouch portion 11 of baby blanket 10 has a depth in the vertical dimension from rim 15 to the bottom of the pouch. This depth is adjustable. At its deepest, pouch portion 11 appears as illustrated in FIG. 3 and the depth extends from rim 15 to the bottom of bottom side 19.

Figure 5:
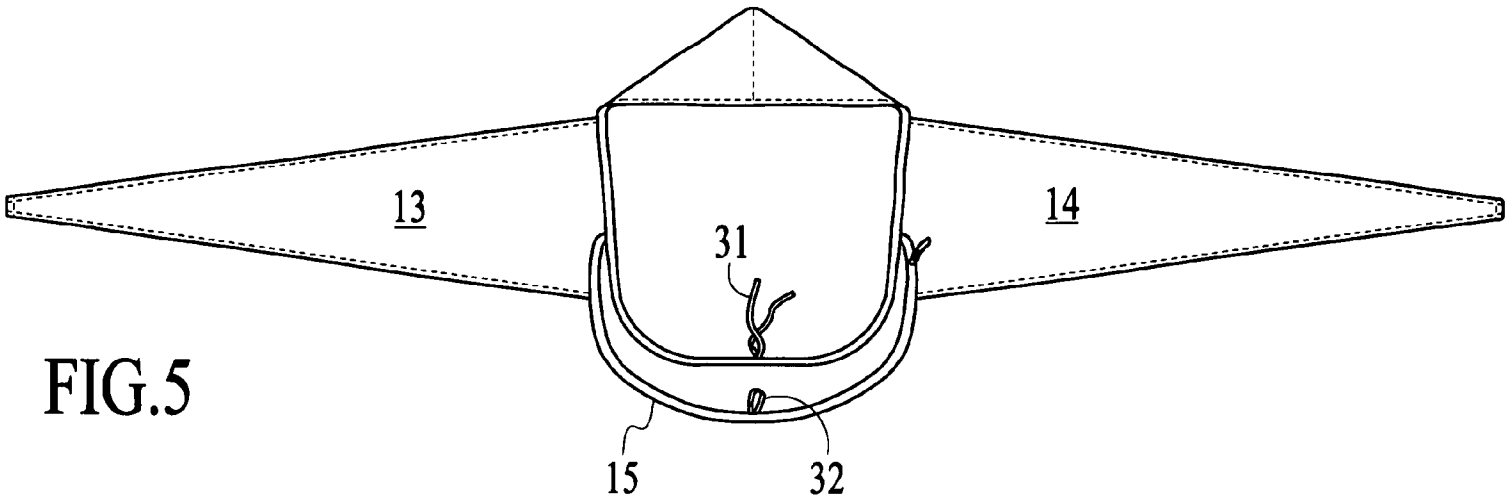
FIGS. 5 and 6 illustrate one example of a mechanism for adjusting the depth of the pouch.

FIG. 5 illustrates a mechanism for adjusting the depth of the pouch. The mechanism includes a first portion 31 and a second portion 32. FIG. 5 is view looking into the inside of the pouch. The first portion 31 is a ribbon that is stitched into the hem at the bottom of bottom side 19. Second portion 32 is a loop stitched to the rim 15.

Figure 6:
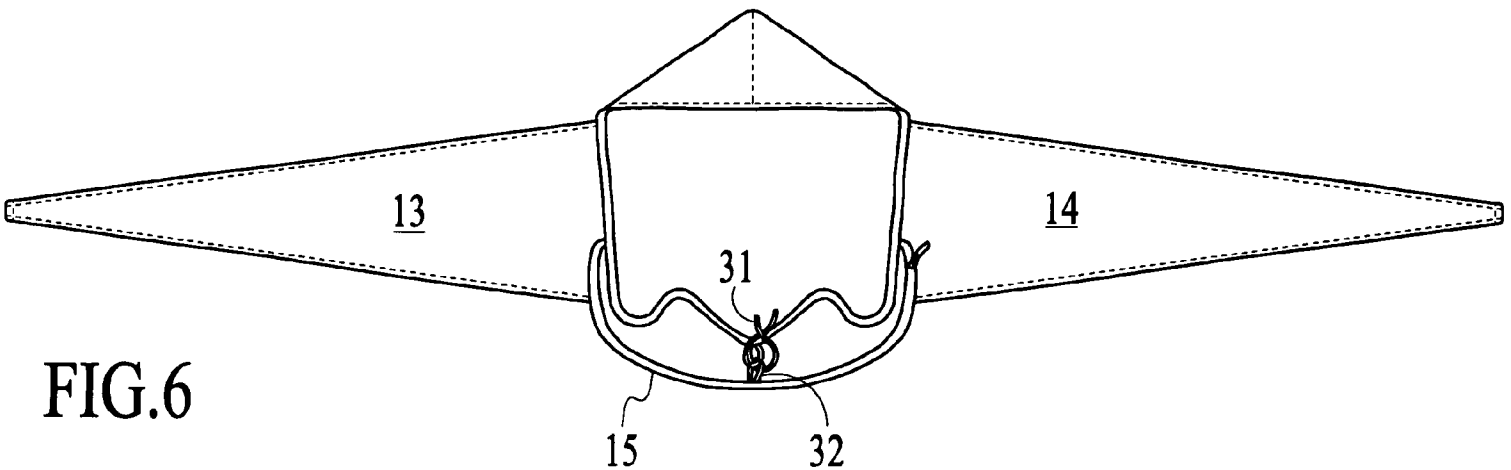

FIG. 6 illustrates how the mechanism can be used to make the pouch less deep. The first portion 31 is tied up to the second portion 32 so that the bottom of the pouch portion is suspended from the rim 15. In the case of the first portion being a ribbon and the second portion being a loop, the ribbon of the first portion can be tied to form a loop such that the loop extends through the loop of the second portion. The amount of ribbon in the loop of the first portion determines the distance that the bottom of the pouch portion is held suspended from rim 15. To have a deeper pouch, the loop of the first portion is tied to be bigger. To have a shallower pouch, the loop of the first portion is tied to be smaller. FIG. 6 shows the loop of the first portion to be small such that the pouch is of minimal depth.

In one advantageous aspect, the first sides (the bottom sides) of the left and right arm extension portions extend from the pouch portion starting at locations below the rim of the opening in the pouch portion. As seen in FIG. 3, the first side 24 of left arm extension portion 13 extends to the left from pouch portion 11 starting at location A. Location A is located approximately three inches below the level of rim 15. Similarly, the first side 27 of right arm extension portion 14 extends to the right from pouch portion 11 starting at location C. Location C is located approximately three inches below the level of rim 15. Because locations A and C are located below the level of rim 15, the left and right arm extension portions 13 and 14 cover or help cover any portions of the baby's body (for example, the baby's arms) that might hang down below the level of rim 15 when the bottom portion of the baby is disposed in pouch portion 11. Because locations A and C are located below the level or rim 15, the left and right arm extensions cover or help cover any portions of the baby's body (for example, the baby's thighs) that might be exposed above the level of the rim 15 when the bottom portion of the baby is disposed in pouch portion 11.

Figure 7:
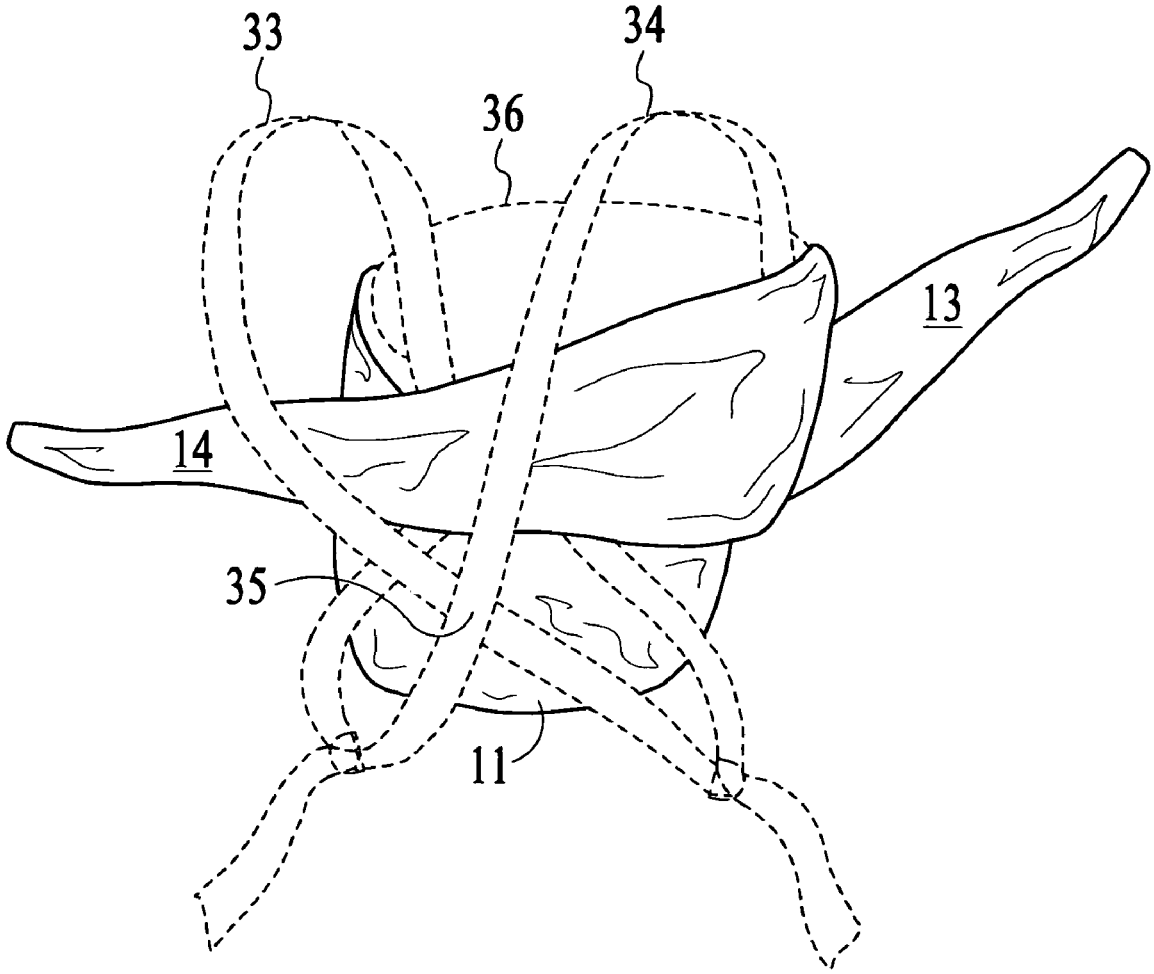
FIG. 7 illustrates how the left and right arm extension portions of baby blanket 10 wrap around the baby carrier and extend between the baby carrier and the wearer.

The use of baby blanket 10 is now described in connection with FIGS. 7-10. FIG. 7 illustrates a front-worn baby carrier in dashed lines. The body of the wearer (for example, parent) of the baby carrier is not shown so that the looping of the straps of the baby carrier and the arm extension portions of the baby blanket can be seen. The body of a baby being carried in the baby carrier is also not shown to clarify the illustration.

Strap 33 is the left shoulder strap of the baby carrier. This strap 33 extends up and over the left shoulder (not shown) of the wearer. Strap 34 is the right should strap of the baby carrier. Strap 34 extends up and over the right shoulder (not shown) of the wearer. Strap 33 crosses strap 34 behind the back of the wearer at location 35. Strap 33 then extends to the right around the right midriff (not shown) of the wearer and hooks into or otherwise attaches to a child-carrying pouch 36 of the baby carrier. Similarly, strap 34 extends to the left around the left midriff (not shown) of the wearer and hooks into or otherwise attaches to the child-carrying pouch 36.

First, the wearer adjusts the depth of the baby blanket pouch to accommodate the size of the baby. This may, for example, be accomplished as explained in connection with FIGS. 5 and 6. The baby is disposed in the child-carrying pouch 36 such that the legs of the baby hang down from leg openings in the child-carrying pouch.

Next, the baby blanket pouch is slipped up around the legs of the baby such that the legs of the baby extend into the pouch portion 11 through the opening 30. The height of the pouch portion 11 of the blanket with respect to the child-carrying pouch 36 of the baby carrier can be varied somewhat. In one example, the rim 15 of pouch portion 11 cuts across the waist of the baby within the child-carrying pouch. The rim 15 is between the naval of the wearer and the child-carrying pouch of the baby carrier.

Next, the wearer pulls on the drawstring 16 to constrict the opening 30 around the baby and baby carrier.

Next, the wearer wraps one of the arm extension portions around the baby and baby carrier such that the arm extension portion extends between the body of the wearer and the baby carrier. In the example of FIG. 7, the left arm extension portion 13 is extended to the right between the body of the wearer and the baby carrier such that the end of the left arm extension portion 13 extends out to the right of the body of the wearer.

Next, the wearer wraps the other of the arm extension portions around the baby and baby carrier such that the arm extension portion extends between the body of the wearer and the baby carrier. In the example of FIG. 7, the right arm extension portion 14 is extended to the left between the body of the wearer and the baby carrier such that the end of the right arm extension portion 14 extends out to the left of the body of the wearer.

Next, the wearer detachably couples the end of the left arm extension portion to the end of the right arm extension portion together at a location on the opposite side of the baby carrier with respect to the wearer. In the example of FIG. 7, the left and right arm extension portions 13 and 14 are later detachably coupled together by tying the left and right arm extension portions together.

Figure 8:
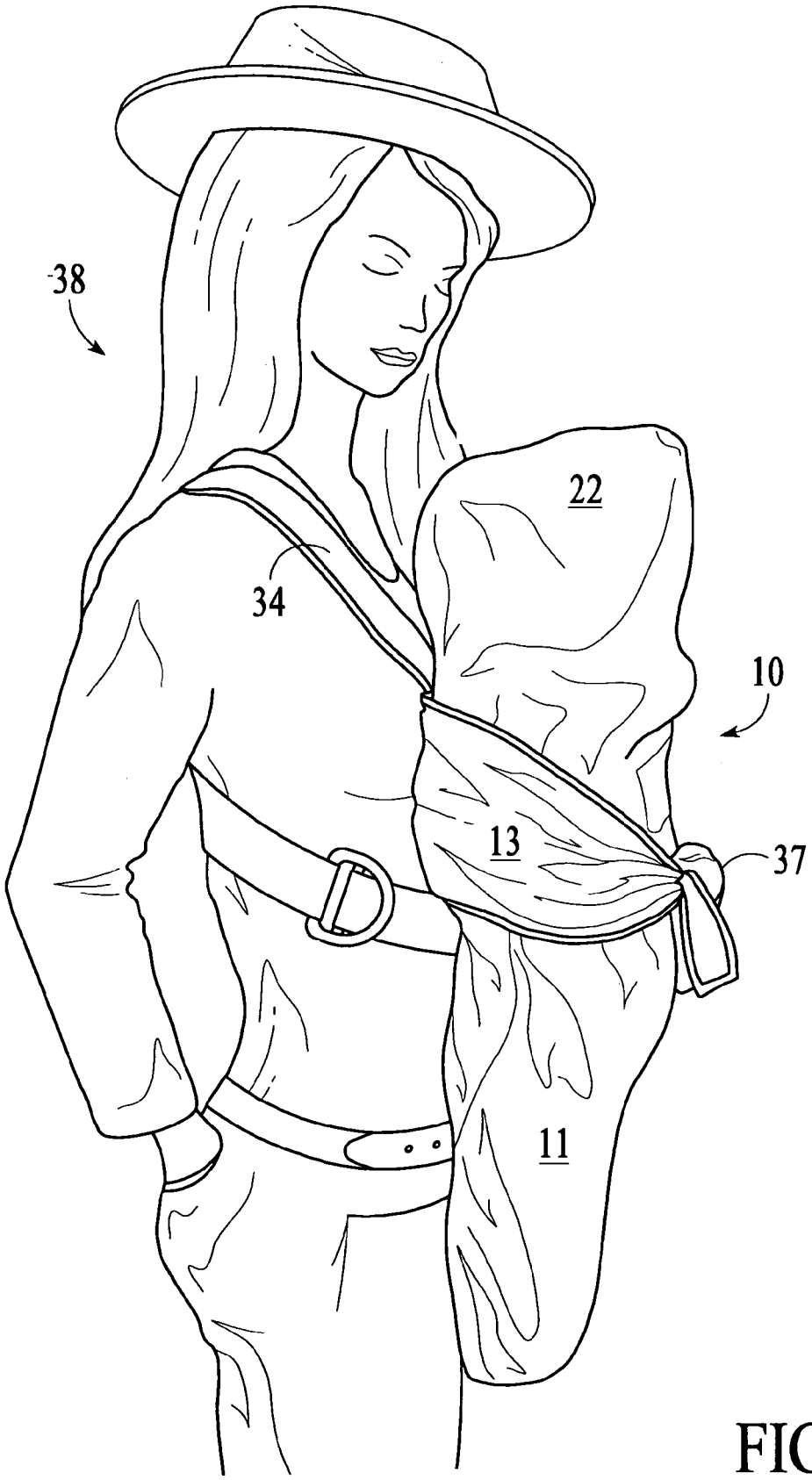
FIGS. 8-10 are perspective views showing baby blanket 10 in use.

FIG. 8 is a perspective view of baby blanket 10 in use. The left arm extension portion 13 is tied to the right arm extension portion 14 in a knot 37. The hood portion 22 is shown covering the head (not shown) of the baby. Note that the left arm extension portion 13 passes between the right shoulder strap 34 and the left shoulder strap 33 (not shown) of the baby carrier and the wearer 38 (in this case, the mother).

Figure 9:
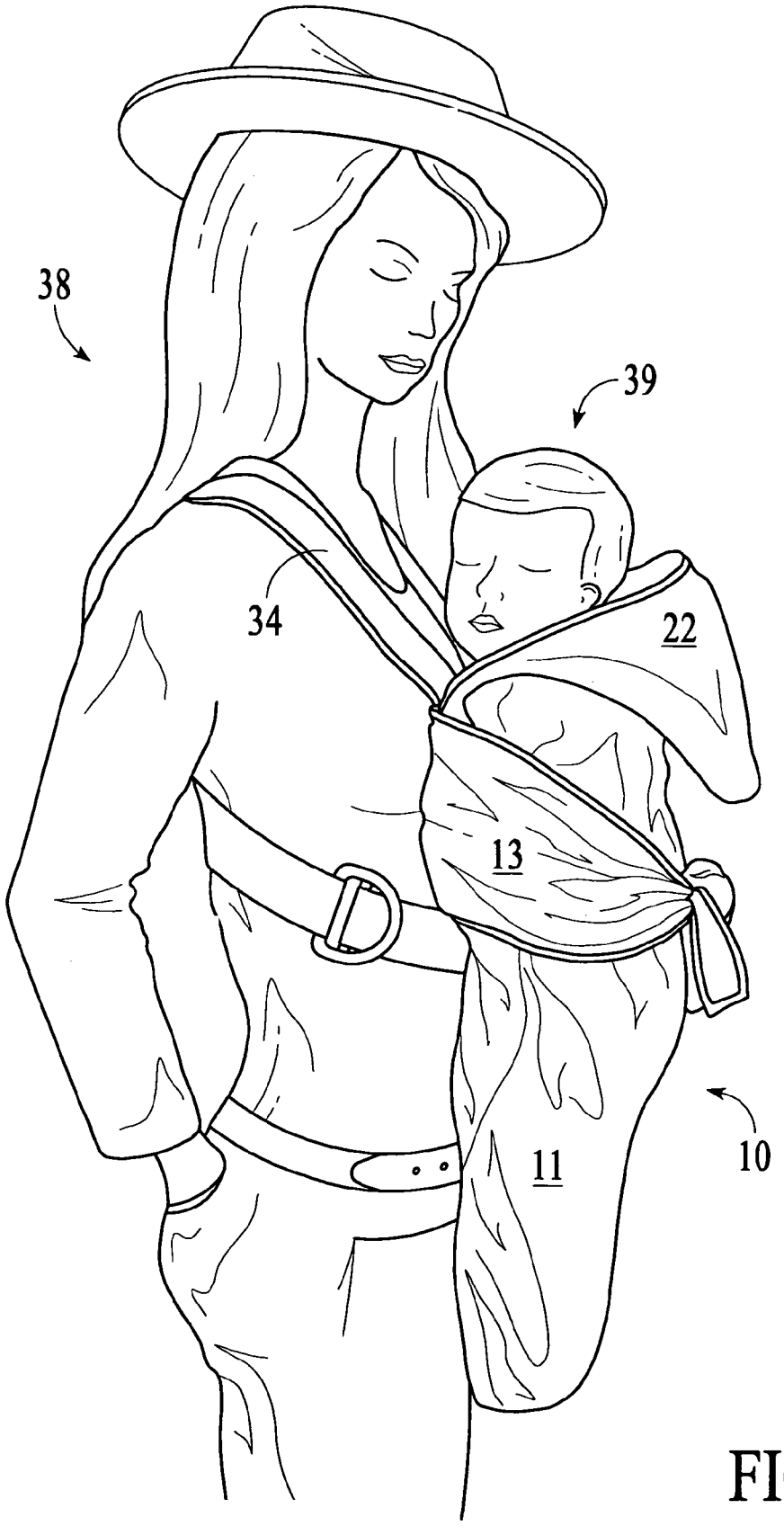

FIG. 9 is a perspective view of the wearer 38 and baby of FIG. 8, except that hood portion 22 is folded back in FIG. 9 to expose the head of the baby 39.

Figure 10:
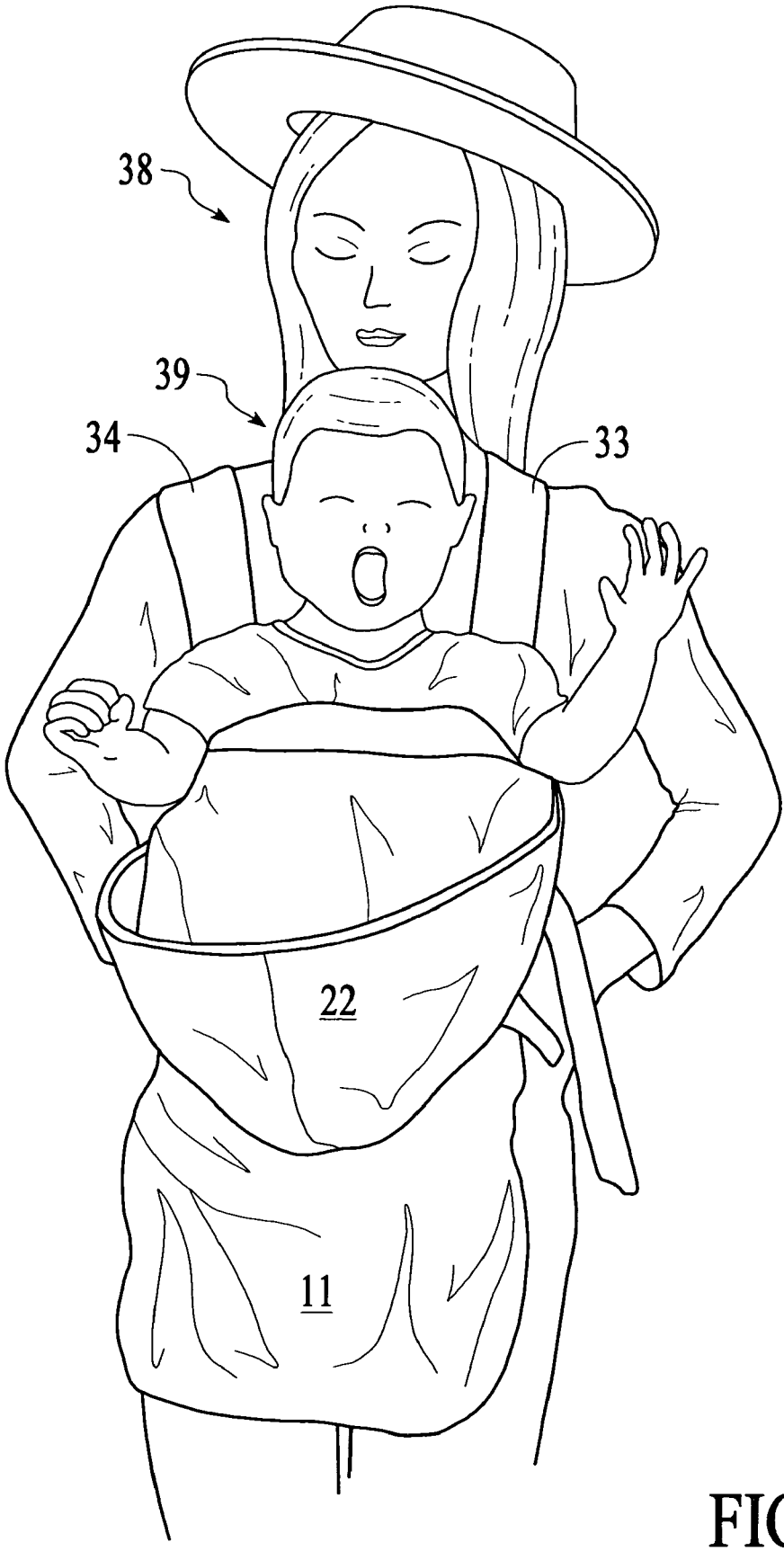

FIG. 10 is a perspective view of baby 39 and wearer 38 from the front. In this illustration, baby 39 is in the outward-facing position, whereas in the illustration of FIG. 9 baby 39 is the inward-facing position.

Although the present invention is described in connection with certain specific embodiments for instructional purposes, the present invention is not limited thereto. The baby blanket need not be made of fleece, but rather can be made of another suitable material, such as cashmere, cotton, or wool. In one embodiment, the baby blanket also includes a removable weatherproof layer. In one embodiment, the baby blanket is constructed entirely in weatherproof fabric. In one embodiment, the baby blanket is constructed in weatherproof fabric with a fleece or another suitable comfortable fabric lining. In one embodiment, the baby blanket is constructed with a hood that is made from a separate piece of fabric from back portion 12 and is fastened to back portion 12 in such a way that the hood can be used with the baby facing in or out in the front-worn carrier. In one embodiment, the baby blanket is constructed with a removable hood. The hood can be separately purchased in various protective and comfortable fabrics. The hood can be constructed in such a way that it is reversible. In one embodiment, the baby blanket is constructed with a removable hood that can be attached to the baby blanket in such a way that the hood can be used with the baby facing in or out in the front-worn carrier. The hood can be constructed in such a way that it provides visor-like protection when the baby is facing out in the front-worn carrier. Although a drawstring is set forth above as an example of the first mechanism usable to constrict the opening in the pouch portion, other examples are possible. The first mechanism may, for example, be an adjustable-length elastic or non-elastic cord with a plastic or metal cord stopper. The first mechanism may be a ribbon or an elastic band with buttonholes that attaches to a button on rim 15 at preset lengths. The first mechanism may be a fabric drawstring that has a plastic or metal cord stopper. The first mechanism may be a Velcro strap that utilizes a metal or plastic loop attached to rim 15 to adjustably constrict the opening in the pouch portion. The first mechanism may be one or two Velcro straps which extend from the back portion 12 to rim 15 or which extend from rim 15 to back portion 12. The first mechanism may be snaps which are attached to rim 15 and are used to constrict the opening in the pouch portion at preset sizes. Although a ribbon and associated loop are set forth above as an example of the second mechanism usable to adjust the depth of the pouch, other examples are possible. The second mechanism may, for example, be a ribbon or Velcro attached to the bottom of the pouch utilizing a metal or plastic loop attached to the inside or rim 15 to adjust the depth of the pouch. The second mechanism may be a ribbon or Velcro attached to the inside of rim 15 utilizing a metal or plastic loop attached to the bottom of the pouch to adjust the depth of the pouch. The second mechanism may be a toggle clasp or two other interlocking clips attached to the inside of rim 15 and the bottom of the pouch, which shorten the depth of the pouch to a preset depth. The second mechanism may be a ribbon or elastic band with buttonholes attached to the bottom of the pouch that attaches to a button on the inside or rim 15 at preset lengths. The second mechanism may be a set of snaps attached to the bottom of the pouch and the inside or rim 15 that shorten the depth of the pouch to a preset depth. Although tapered left and right arm extension portions are illustrated in the description above, left and right arm extensions need not be tapered. The left and right arm extensions are, in other embodiments, substantially rectangularly shaped and do not taper. Although the left and right arm extensions are detachable coupled by tying in the description above, other ways of detachably coupling are possible. In another embodiment, the detachable coupling of the left and right arm extension portions is accomplished by Velcro which affixes the arm extensions to the back portion 12. Although the baby blanket is set forth as being used to cover a baby in a front-worn baby carrier, the baby blanket may also be used to cover a baby in other devices used to transport babies. For example, in one embodiment, the baby blanket can be used in a stroller or a carseat by providing a reinforced slit no wider than five inches in back portion 12. This opening accommodates the passing through of a buckle as found in a five-point harness on a carseat or stroller. The buckle comes between the baby's legs and up through the baby blanket, then clips to the second portion of the restraining harness device. Accordingly, various modifications, adaptations, and combinations of various features of the described embodiments can be practiced without departing from the scope of the invention as set forth in the claims.

What is claimed is:

1. A method for covering a baby with a blanket, the baby being carried in a front-worn baby carrier, the blanket having a pouch portion, a first arm extension portion and a second arm extension portion, the pouch portion having a first mechanism constricting an opening of the pouch portion, the pouch portion having a second mechanism for adjusting a depth of the pouch portion, the method comprising:

using the second mechanism to adjust the depth of the pouch portion;

slipping the pouch portion up around the legs of the baby such that the legs of the baby extend into the pouch portion through the opening;

using the first mechanism to constrict the opening around the baby;

wrapping the first arm extension portion around the baby carrier such that the first arm extension portion extends between a person wearing the baby carrier and at least a portion of the baby carrier;

wrapping the second arm extension portion around the baby carrier such that the second arm extension portion extends between the person and at least a portion of the baby carrier; and detachably coupling the first arm extension portion and the second arm extension portion together at a location on the opposite side of the baby carrier with respect to the person.

2. The method of claim 1, wherein the pouch portion, the first arm extension portion and the second arm extension portion comprise fleece material, wherein the first arm extension portion has a substantially triangular shape, wherein the second arm extension portion has a substantially triangular shape, and wherein the first and second arm extension portions are detachably coupled together by tying the first and second arm extension portions together.

3. A method for using a fabric article to cover a baby, the baby being carried in a front-worn baby carrier, the fabric article including a pouch portion, a first arm extension portion, and a second arm extension portion, the method comprising:

slipping the pouch portion of the fabric article up around the legs of the baby when the baby is in the front-worn baby carrier;

wrapping the first arm extension portion around the baby carrier such that the first arm extension portion extends between a person wearing the baby carrier and at least a portion of the baby carrier;

wrapping the second arm extension portion around the baby carrier such that the second arm extension portion extends between the person and at least a portion of the baby carrier; and tying the first arm extension portion and the second arm extension portion together at a location on the opposite side of the baby carrier with respect to the person.

4. The method of claim 3, wherein the fabric article further includes a back portion that extends upward from the pouch portion, wherein if the fabric article is laying flat with the pouch portion collapsed and the first and second arm extension portions extended and laying flat then the pouch portion has a width, the first arm extension portion extending laterally from the pouch portion a distance that is substantially greater than the width of the pouch portion, the second arm extension portion extending laterally from the pouch portion a distance that is substantially greater than the width of the pouch portion.

5. A method comprising:

orienting a baby blanket such that at least a portion of a front-worn baby carrier is between a back portion of the baby blanket and a person wearing the baby carrier, wherein the baby blanket includes the back portion, a pouch portion, a first arm extension portion, and a second arm extension portion, wherein the back portion extends upward from the pouch portion, wherein the pouch portion has a width, wherein the first arm extension portion has a length that is substantially greater than the width of the pouch portion, wherein the second arm extension portion has a length that is substantially greater than the width of the pouch portion, and wherein the pouch portion has an opening, the opening having an adjustable circumference;

wrapping the first arm extension portion around the baby carrier such that the first arm extension portion extends between the chest of the person and at least a portion of the baby carrier;

wrapping the second arm extension portion around the baby carrier such that the second arm extension portion extends between the chest of person and at least a portion of the baby carrier; and detachably coupling the first arm extension portion to the second arm extension portion at a location on the opposite side of the baby carrier with respect to the person.

6. The method of claim 5, wherein the length of the first arm extension portion is at least twice the width of the pouch portion, and wherein the length of the second arm extension portion is at least twice the width of the pouch portion.

7. The method of claim 1, wherein the blanket comprises a back portion that extends upward from the pouch portion when the blanket is viewed upright from a frontal perspective, wherein the first arm extension portion has a substantially triangular shape and has a vertical side, wherein the vertical side of the first arm extension portion extends upward from a location A on the pouch portion, along a first vertical side of the pouch portion and upward along a first vertical side of the back portion to a location B, wherein a second arm extension portion has a substantially triangular shape and has a vertical side, wherein the vertical side of the second arm extension portion extends upward from a location C on the pouch portion, along a second side of the pouch portion and upward along a second vertical side of the back portion to a location D, and wherein locations A and C are located below the level of the opening in the pouch portion.

* * * * *